US010117496B2

(12) United States Patent
Chen

(10) Patent No.: US 10,117,496 B2
(45) Date of Patent: Nov. 6, 2018

(54) DROPPER AND COSMETICS CONTAINER HAVING THE SAME

(71) Applicant: Wensheng Chen, Jiangsu (CN)

(72) Inventor: Wensheng Chen, Suzhou (CN)

(73) Assignees: Wensheng Chen, Suzhou, Jiangsu (CN); Andrea Perego, Castello di Brianza (Lecco) (IT)

( * ) Notice: Subject to any disclaimer, the term of this patent is extended or adjusted under 35 U.S.C. 154(b) by 0 days.

(21) Appl. No.: 15/126,304

(22) PCT Filed: Mar. 19, 2014

(86) PCT No.: PCT/CN2014/073708
§ 371 (c)(1),
(2) Date: Sep. 15, 2016

(87) PCT Pub. No.: WO2015/139240
PCT Pub. Date: Sep. 24, 2015

(65) Prior Publication Data

US 2017/0079407 A1 Mar. 23, 2017

(51) Int. Cl.
*A45D 34/00* (2006.01)
*A45D 34/04* (2006.01)
(Continued)

(52) U.S. Cl.
CPC ..... *A45D 34/045* (2013.01); *A45D 34/04* (2013.01); *A45D 34/041* (2013.01);
(Continued)

(58) Field of Classification Search
CPC ... A45D 34/042; A45D 34/045; A45D 34/046
(Continued)

(56) References Cited

U.S. PATENT DOCUMENTS 531,133 A * 12/1894 Pomeroy ..... B01L 3/0282 141/24
7,467,906 B2 * 12/2008 Gueret ..... A45D 34/042 401/119
2014/0020789 A1 * 1/2014 Duquet ..... A45D 34/04 141/24

FOREIGN PATENT DOCUMENTS

CN 201524254 U 7/2010
CN 202950176 U 5/2013
(Continued)

OTHER PUBLICATIONS

International Search Report for PCT/CN2014/073708, eight pages, dated Dec. 19, 2014, with English translation.

*Primary Examiner* — David Walczak
*Assistant Examiner* — Joshua Wiljanen
(74) *Attorney, Agent, or Firm* — Vorys, Sater, Seymour and Pease LLP; Ari G. Zytcer

(57) ABSTRACT

Provided is a dropper which includes a flexible cap, a tube body, and a head component. The flexible cap may be hermetically connected to one end of the tube body, and the head component may be connected to the other end of the tube body. The tube body may be hollow tube body. The flexible cap can be deformed, and the interior thereof is a hollow structure. An internal hollow part of the tube body communicates with the internal hollow part of the flexible cap. The head component is provided with an interconnecting structure for fluid to pass through such that fluid is able to enter the tube body or flow out of the tube body via the interconnecting structure.

9 Claims, 10 Drawing Sheets

(51) Int. Cl.

| | |
|---|---|
| ***A46B 11/00*** | (2006.01) |
| ***A46B 15/00*** | (2006.01) |
| ***B65D 47/18*** | (2006.01) |

(52) U.S. Cl.
CPC ..... *A45D 34/042* (2013.01); *A45D 34/046* (2013.01); *A46B 11/002* (2013.01); *A46B 15/0055* (2013.01); *B65D 47/18* (2013.01); *A45D 2200/054* (2013.01); *A45D 2200/1018* (2013.01); *A46B 2200/20* (2013.01)

(58) Field of Classification Search
USPC ..... 401/119, 121, 122, 123, 124, 126, 127, 401/128, 129, 130, 158, 184, 185; 222/420
See application file for complete search history.

(56) References Cited

FOREIGN PATENT DOCUMENTS

| | | | |
|---|---|---|---|
| CN | 202987815 | U | 6/2013 |
| CN | 103263142 | A | 8/2013 |
| CN | 203194868 | U | 9/2013 |
| CN | 203467894 | U | 3/2014 |
| EP | 0 105 719 | A2 | 4/1984 |

* cited by examiner

DROPPER AND COSMETICS CONTAINER HAVING THE SAME

TECHNICAL FIELD

The present invention relates to the field of a cosmetics container, and more particularly, to a dropper and a cosmetics container having the same.

BACKGROUND

Currently, an eye liner, a lip gloss and the like have become common cosmetics that are handy to carry with by ladies, while an existing container for accommodating the eye liner, lip gloss, foundation liquids, skin products and the like) is unlikely to meet (special) requirements for use. An ordinary container is a bottle body matched with a dipping head, and cosmetics are held in the bottle body. When it is necessary to use, the cosmetics are constantly dipped by the dipping head from the bottle body in a direct manner until finishing makeup. However, it is very inconvenient to use such container as it needs to constantly dip the cosmetics. Moreover, chemical activity of some cosmetics is strong. In this way, the cosmetics are easily deteriorated so much as they come into contact with air during the course of constantly dipping. At the same time, it is unable to accurately control a dipping amount at all when dipping the cosmetics from the ordinary cosmetics container. If the amount of the cosmetics is dipped too much, the makeup may not be operated normally.

SUMMARY

The present invention aims at providing a cosmetics container, which is convenient to use.

According to an object of the present invention, one aspect of the present invention is to provide a dropper, comprising a flexible cap, a tube body and a head component, wherein the flexible cap is hermetically connected to one end of the tube body, ensuring that air leakage does not occur between the flexible cap and the tube body, and the head component is connected to the other end of the tube body; the head component is also hermetically connected to the tube body to the greatest extent; the tube body is a hollow tube body; the flexible cap can be deformed, and the interior thereof is a hollow structure; an internal hollow part of the tube body communicates with the internal hollow part of the flexible cap; the head component is provided with an interconnecting structure thereon for fluid to pass through, fluid thus being able to enter the tube body (102) or flow out of the tube body via the interconnecting structure.

Its advantageous effect is that the flexible cap in the present invention may either adopt a rubber cap or be a flexible cap pressed from up to down. The flexible cap needs to achieve a function that the flexile cap may be deformed when being pressed, being extruded and being under other operations, and generate a certain suction force when being deformed. When used, a user may firstly extrude the flexible cap, then release to absorb the cosmetic substance in the tube body, and then slowly control the cosmetic substance in the tube body to flow out of the tube body via the deformation of the flexible cap slowly, and use during the course of slowly flowing out. Such dropper may be used to be extracted once, so as to protect the cosmetics from being deteriorated. In the meanwhile, if the user is intended to control a deformation amount of the flexible cap slightly, an amount of the extracted cosmetics may be controlled on purpose. The extracted amount may be determined according to the needs of the user.

In some embodiments, the head component is a soft head, the soft head comprises a connecting portion and a contact portion which are integrally formed, an outer diameter of the contact portion is greater than the outer diameter of the connecting portion, the connecting portion is inserted in the tube body, the contact portion is provided with a contact surface, the interconnecting structure refers to a through hole arranged in the contact surface, and the through hole communicates with the internal hollow part of the tube body. Its advantageous effect is that cosmetics may slowly flow out of the through hole of the contact surface, and then a user may apply or wipe, or implement other makeup operations via the contact surface of the contact portion.

In some embodiments, the head component is a brush, the brush comprises a brush handle and brush hairs, one end of the brush handle is inserted in the tube body, while the other end of the brush handle is connected with the brush hairs, the brush handle is a hollow structure, the interconnecting structure refers to a gap between the brush hairs, the fluid may enter the tube body or flow out of the tube body via the gap between the brush hairs and the hollow structure of the brush handle. Its advantageous effect is that cosmetics may slowly flow out of the gap between the brush hairs, and then the user may apply or wipe, or implement other makeup operations via the brush hairs.

In some embodiments, the exterior of the flexible cap is sheathed with a top cover, the interior of the top cover is provided with an accommodating space, the flexible cap is arranged inside the top cover, a side wall of the top cover is provided with a notch, and the flexible cap corresponds to the notch. Its advantageous effect is that the arrangement of the top cover prevents the flexible cap from being damaged, and meanwhile, the arrangement of the notch is incapable of keeping the user from normally extruding the flexible cap.

In some embodiments, two notches are provided and are symmetrically arranged in the side wall of the top cover, and a section view of the notch is arc-shaped. Its advantageous effect is that the arrangement of the two notches is convenient for the user to implement extrusion operation with a forefinger and a thumb at the same time.

In some embodiments, the flexible cap is a push type flexible cap, a pressing cover is arranged above the push type flexible cap, and the pressing cover is matched with the top cover. Its advantageous effect is that the flexible cap of the present invention may also adopt a push type flexible cap. The cosmetics may be extracted accurately and quantitatively by controlling the deformation amount of the push type flexible cap.

The other aspect of the present invention is to provide a cosmetics container, comprising a container body and the dropper, wherein the container body has a function of accommodating fluid, and the dropper is stretched into the container body. Its advantageous effect is that through matching with the dropper provided in the present invention in the cosmetics container, the cosmetics substance may be firstly absorbed in the tube body, and then the cosmetics substance in the tube body may be slowly controlled to flow out via the interconnecting structure, and may be used during the course of slowly flowing out in the meanwhile. Such cosmetics container may be extremely convenient for the user, and particularly, suitable for portable cosmetics.

In some embodiments, the cosmetics container further comprises an inner cover, wherein the top of the container body is provided with a binding portion, the inner cover is matched with the container body via the binding portion, the top of the inner cover is hollow, the hollow part of the top of the inner cover is provided with an inward flange, and the outside of the top of the flexible cap is provided with a groove matched with the flange. Its advantageous effect is that the binding portion may be a screw thread or a slot, and an inner side wall of the inner cover is provided with a screw thread or a cutting wood matched with the binding portion. At the same time, the inner cover may be connected with the flexible cap well by matching the flange with the groove.

In some embodiments, the exterior of the flexible cap is sheathed with a top cover, the interior of the top is provided with an accommodating space, the flexible cap is arranged inside the top cover, a side wall of the top cover is provided with a notch, the flexible cap corresponds to the notch, two notches are provided and are symmetrically arranged in the side wall of the top cover, a section view of the notch is arc-shaped, an outside wall of the inner cover is provided with a bead, and the top cover is provided with a groove matched with the bead. Its advantageous effect is that the arrangement of the top cover prevents the flexible cap from being damaged, and meanwhile, the arrangement of the notches is incapable of keeping the user from normally extruding the flexible cap. The arrangement of the two notches is convenient for the user to implement extrusion operation with a forefinger and a thumb at the same time.

In some embodiments, the cosmetics container further comprises a chock plug in a hollow structure, the chock plug is located at the top of the container body, the chock plug is inserted in and fixed on an opening of the container body, the tube body passes through the chock plug and is inserted inside the container body, and an inner diameter of the chock plug is matched with an outer diameter of the tube body. Its advantageous effect is that, on the one hand, the chock plug and the tube body are matched together to achieve a better sealing effect, thus preventing the cosmetics in the container body from flowing out; on the other hand, when the dropper is pulled out, the head component passes through the hollow structure of the chock plug. As the inner diameter of the chock plug is matched with the outer diameter of the tube body, the inner side wall of the chock plug may scrape away the unnecessary cosmetics dipped in the head component, thus preventing the head component from being dipped with the unnecessary cosmetics to effect on its use.

DETAILED DESCRIPTION

The present invention is further described for details with reference to FIG. 1 to FIG. 8 hereinafter.

Figure 1:
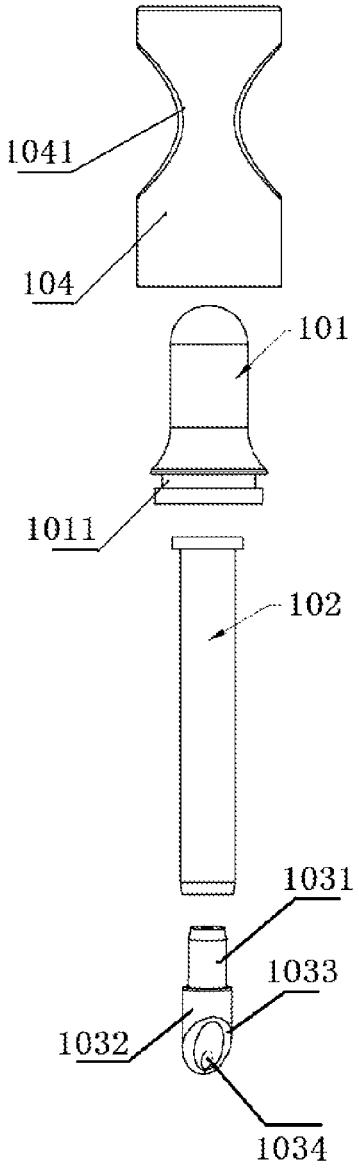
FIG. 1 is a structural schematic diagram of a dropper of one implementation manner of the present invention.

Firstly, a dropper provided by the present invention is described for details. FIG. 1 illustrates a dropper of one implementation manner of the present invention, comprising a flexible cap 101, a tube body 102 and a head component, wherein the flexible cap 101 is hermetically connected to one end of the tube body 102, so as to ensure that no air leakage occurs between the flexible cap 101 and the tube body 102. When the flexible cap 101 is deformed, an air pressure in the tube body 102 is changed to generate a negative pressure, thus generating a suction force. The head component is connected to the other end of the tube body 102; the tube body 102 is a hollow tube body 102; the flexible cap 101 can be deformed, and the interior thereof is a hollow structure; an internal hollow part of the tube body 102 communicates with the internal hollow part of the flexible cap 101; the head component is provided with an interconnecting structure thereon for fluid to pass through, fluid thus being able to enter the tube body 102 or flow out of the tube body 102 via the interconnecting structure.

The flexible cap 101 in the present invention may either adopt a rubber cap or be a flexible cap pressed from up to down. The flexible cap 101 needs to achieve a function that the flexile cap 101 may be deformed when being pressed, being extruded and being under other operations, and generate a certain suction force when being deformed. When used, a user may firstly extrude the flexible cap 101, then release to absorb the cosmetic substance in the tube body 102, and then slowly control the cosmetic substance in the tube body 102 to flow out of the tube body via the deformation of the flexible cap 101 slowly, and use during the course of slowly flowing out. Such dropper may be used to be extracted once, so as to protect the cosmetics from being deteriorated. In the meanwhile, if the user is intended to control a deformation amount of the flexible cap 101 slightly, an amount of the extracted cosmetics may be controlled on purpose. The extracted amount may be determined according to the needs of the user.

Wherein, the head component in the present invention may be in various forms. In an embodiment 1 as illustrated in FIG. 1, the head component therein is a soft head, the soft head comprises a connecting portion 1031 and a contact portion 1032 which are integrally formed, an outer diameter of the contact portion 1032 is greater than the outer diameter of the connecting portion 1031, the connecting portion 1031 is inserted in the tube body 102, and the connecting portion 1031 is not hermetically connected with the tube body 102. When used, the whole soft head and a part of the tube body 102 need to be inserted in the cosmetics, thus generating a liquid seal to prevent air leakage. Accordingly, the cosmetics are smoothly absorbed in the tube body 102. The contact portion 1032 is provided with a contact surface 1033, the interconnecting structure refers to a through hole 1034 arranged in the contact surface 1033, and the through hole 1034 communicates with the internal hollow part of the tube body 102. Its advantageous effect is that cosmetics may slowly flow out of the through hole 1034 of the contact surface 1033, and then a user may apply or wipe, or implement other makeup operations via the contact surface 1033 of the contact portion 1032.

An embodiment 2 provides a preferable solution, the difference between the embodiment 2 and the embodiment 1 is that: the connecting portion 1031 is hermetically connected with the tube body 102, so that a user may insert the contact portion of the soft head in the cosmetics to be absorbed, rather than needing to insert the whole soft head in the cosmetics. In this way, the side wall of the tube body 102 is not dipped with the cosmetics, so that it is convenient for the user to use.

Figure 2:
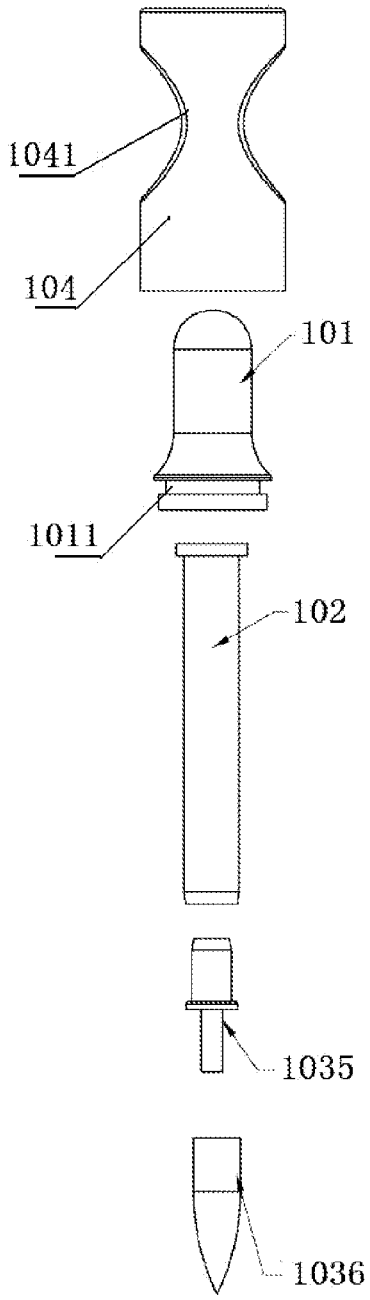
FIG. 2 is a structural schematic diagram of a dropper of the other implementation manner of the present invention.

FIG. 2 illustrates an embodiment 3. The head component in the embodiment is a brush, the brush comprises a brush handle 1035 and brush hairs 1036, and the brush handle 1035 is not hermetically connected with the tube body 102. When used, the whole brush and a part of the tube body 102 need to be inserted in the cosmetics, thus generating a liquid seal to prevent air leakage. Accordingly, the cosmetics are smoothly absorbed in the tube body 102. One end of the brush handle 1035 is inserted in the tube body 102, while the other end of the brush handle 1035 is connected with the brush hairs 1036, the brush handle 1035 is a hollow structure, the interconnecting structure refers to a gap between the brush hairs 1036, the fluid may enter the tube body 102 or flow out of the tube body 102 via the gap between the brush hairs 1036 and the hollow structure of the brush handle 1035. Its advantageous effect is that cosmetics may slowly flow out of the gap between the brush hairs 1036, and then the user may apply or wipe, or implement other makeup operations via the brush hairs 1036.

An embodiment 4 provides a preferable solution, the difference between the embodiment 4 and the embodiment 3 is that: the brush handle 1035 is hermetically connected with the tube body 102, so that a user may insert the brush handle 1035 of the brush in the cosmetics to be absorbed merely, rather than needing to insert the whole brush in the cosmetics. In this way, the side wall of the tube body 102 is not dipped with the cosmetics, so that it is convenient for the user to use.

In order to protect the flexible cap 101 to the greatest extent, the exterior of the flexible cap 101 may also be sheathed with a top cover 104, the interior of the top is provided with an accommodating space, the flexible cap 101 is arranged inside the top cover 104, a side wall of the top cover 104 is provided with a notch 1041, and the flexible cap 101 corresponds to the notch 1041. Its advantageous effect is that the arrangement of the top cover 104 prevents the flexible cap 101 from being damaged, and meanwhile, the arrangement of the notches 1041 is incapable of keeping the user from normally pressing the flexible cap 101.

Two notches 1041 in the top cover 104 may be provided, the two notches 1041 are symmetrically arranged in the side wall of the top cover 104, and a section view of the notch 1041 is arc-shaped. Its advantageous effect is that the arrangement of the two notches 1041 is convenient for the user to implement extrusion operation with a forefinger and a thumb at the same time.

Figure 9:
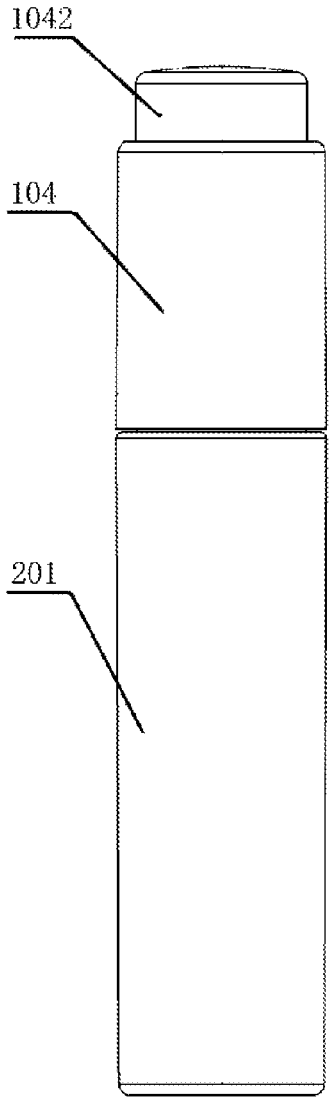
FIG. 9 is a structural schematic diagram of a cosmetics container of one implementation manner of the present invention.
Figure 10:
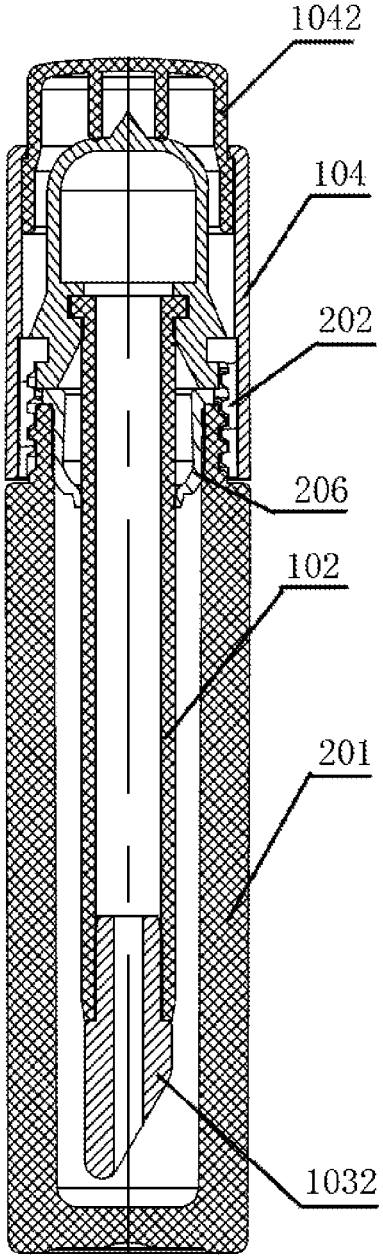
FIG. 10 is a sectional view of the cosmetics container as illustrated in FIG. 9.

Besides the above-mentioned implementation manner, the flexible cap 101 of the present invention may also have various implementation manners. As illustrated in FIG. 9 and FIG. 10, the flexible cap of the present invention may also be a push type flexible cap 101. A pressing cover 1042 is arranged above the push type flexible cap 101, the pressing cover 1042 is matched with the top cover 104, a round hole may be arranged in the top of the top cover 104 normally, and then the pressing cover is arranged in the round hole. The cosmetics may be extracted accurately and quantitatively by controlling the deformation amount of the push type flexible cap 101.

Figure 3:
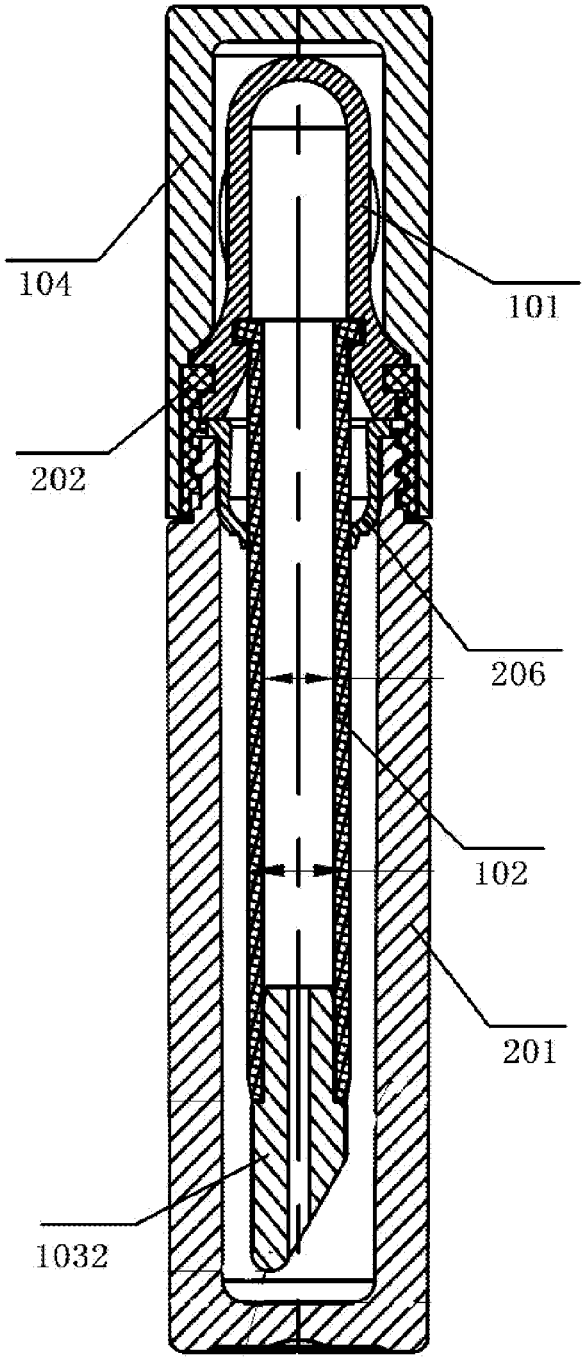
FIG. 3 is a structural schematic diagram of a cosmetics container having the dropper as illustrated in FIG. 1.
Figure 4:
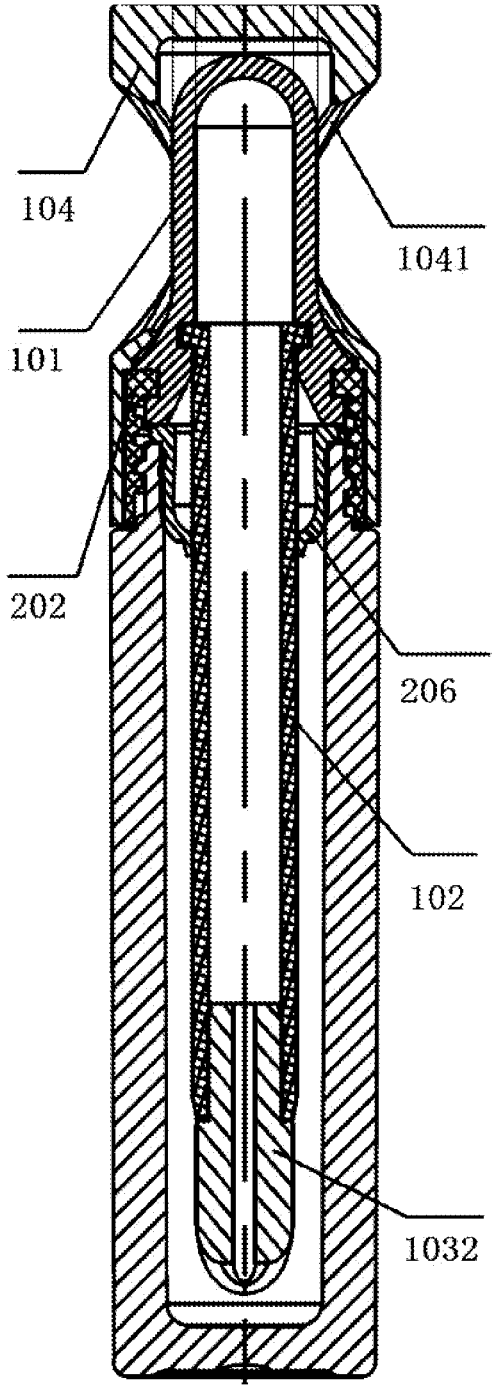
FIG. 4 is a schematic diagram of another perspective of FIG. 3.
Figure 5:
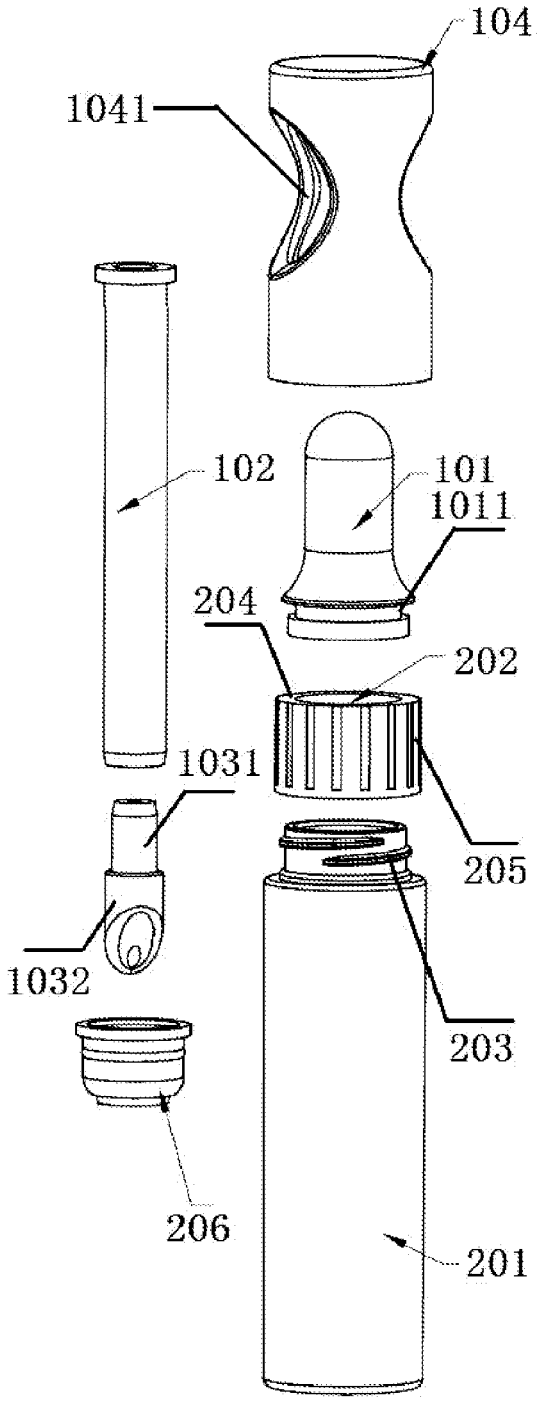
FIG. 5 is a schematic diagram of a decomposition state of FIG. 3.

Then, the cosmetics container having the above-mentioned dropper provided by the present invention is described, as illustrated in figure. FIG. 3 to FIG. 5 illustrate a cosmetics container provided according to the other aspect of the present invention, comprising a container body 201 and a dropper, wherein the container body 201 has a function of accommodating the fluid, the dropper comprises a flexible cap 101, a tube body 102 and a head component, wherein the flexible cap 101 is hermetically connected to one end of the tube body 102, and the head component is connected to the other end of the tube body 102. The dropper is stretched into the container body 201. Wherein, the head component is a soft head, the soft head comprises a connecting portion 1031 and a contact portion 1032 which are integrally formed, an outer diameter of the contact portion 1032 is greater than the outer diameter of the connecting portion 1031, the connecting portion 1031 is inserted in the tube body 102, the contact portion 1032 is provided with a contact surface 1033, the interconnecting structure refers to a through hole 1034 arranged in the contact surface 1033, and the through hole 1034 communicates with the internal hollow part of the tube body 102. The cosmetics may slowly flow out of the through hole 1034 of the contact surface 1033, and then a user may apply or wipe, or implement other makeup operations via the contact surface 1033 of the contact portion 1032. Through matching with the dropper provided in the present invention in the cosmetics container, the cosmetics substance may be firstly absorbed in the tube body 102, and then the cosmetics substance in the tube body 102 may be slowly controlled to flow out via the interconnecting structure, and may be used during the course of slowly flowing out in the meanwhile. Such cosmetics container may be extremely convenient for the user, and particularly, suitable for portable cosmetics.

At the same time, the cosmetics container of the present invention further comprises an inner cover 202, wherein the top of the container body 201 is provided with a binding portion 203, the inner cover 202 is matched with the container body 201 via the binding portion 203, the top of the inner cover 202 is hollow, the hollow part of the top of the inner cover 202 is provided with an inward flange 204, and the outside of the top of the flexible cap 101 is provided with a groove 1011 matched with the flange 204. Wherein, the binding portion 203 may be a screw thread or a slot, and an inner side wall of the inner cover 202 is provided with a screw thread or a cutting wood matched with the binding portion 203. At the same time, the inner cover 202 may be connected with the flexible cap 101 well by matching the flange 204 with the groove 1011.

In order to protect the flexible cap 101, the exterior of the flexible cap 101 may also be sheathed with a top cover 104 in the meanwhile, the interior of the top is provided with an accommodating space, the flexible cap 101 is arranged inside the top cover 104, a side wall of the top cover 104 is provided with a notch 1041, the flexible cap 101 corresponds to the notch 1041, two notches 1041 are provided and are symmetrically arranged in the side wall of the top cover 104, a section view of the notch 1041 is arc-shaped, an outside wall of the inner cover 202 is provided with a bead 205, and the top cover 104 is provided with a groove matched with the bead 205. Its advantageous effect is that the arrangement of the top cover 104 prevents the flexible cap 101 from being damaged, and meanwhile, the arrangement of the notches 1041 is incapable of keeping the user from normally extruding the flexible cap 101. The arrangement of the two notches 1041 is convenient for the user to implement extrusion operation with a forefinger and a thumb at the same time.

At the same time, the cosmetics container further comprises a chock plug 206 in a hollow structure, wherein the chock plug 206 is located at the top of the container body 201, the chock plug 206 is inserted in and fixed on an opening of the container body 201, the tube body 102 passes through the chock plug 206 and is inserted inside the container body 201, and an inner diameter of the chock plug 206 is matched with an outer diameter of the tube body 102. Its advantageous effect is that, on the one hand, the chock plug 206 and the tube body 102 are matched together to achieve a better sealing effect, thus preventing the cosmetics in the container body 201 from flowing out; on the other hand, when the dropper is pulled out, the head component passes through the hollow structure of the chock plug 206. As the inner diameter of the chock plug 206 is matched with the outer diameter of the tube body 102, the inner side wall of the chock plug 206 may scrape away the unnecessary cosmetics dipped in the head component, thus preventing the head component from being dipped with the unnecessary cosmetics to effect on its use.

Figure 6:
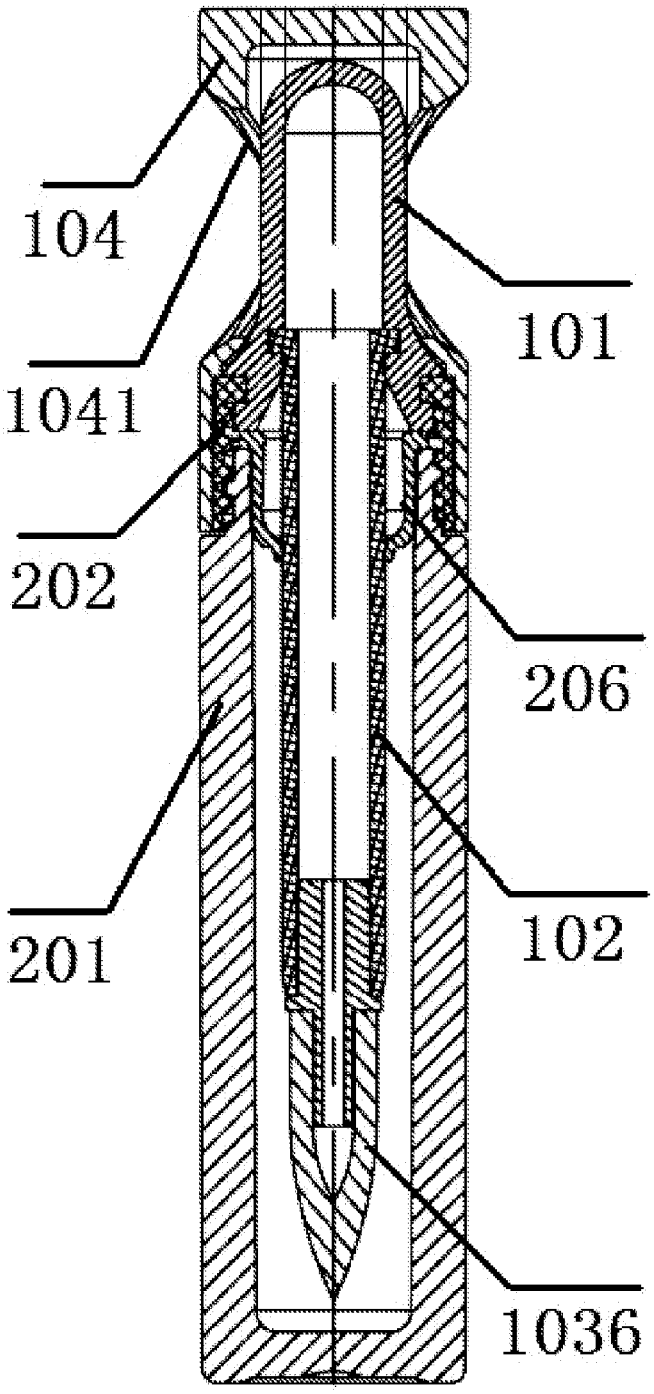
FIG. 6 is a structural schematic diagram of a cosmetics container having the dropper as illustrated in FIG. 2.
Figure 7:
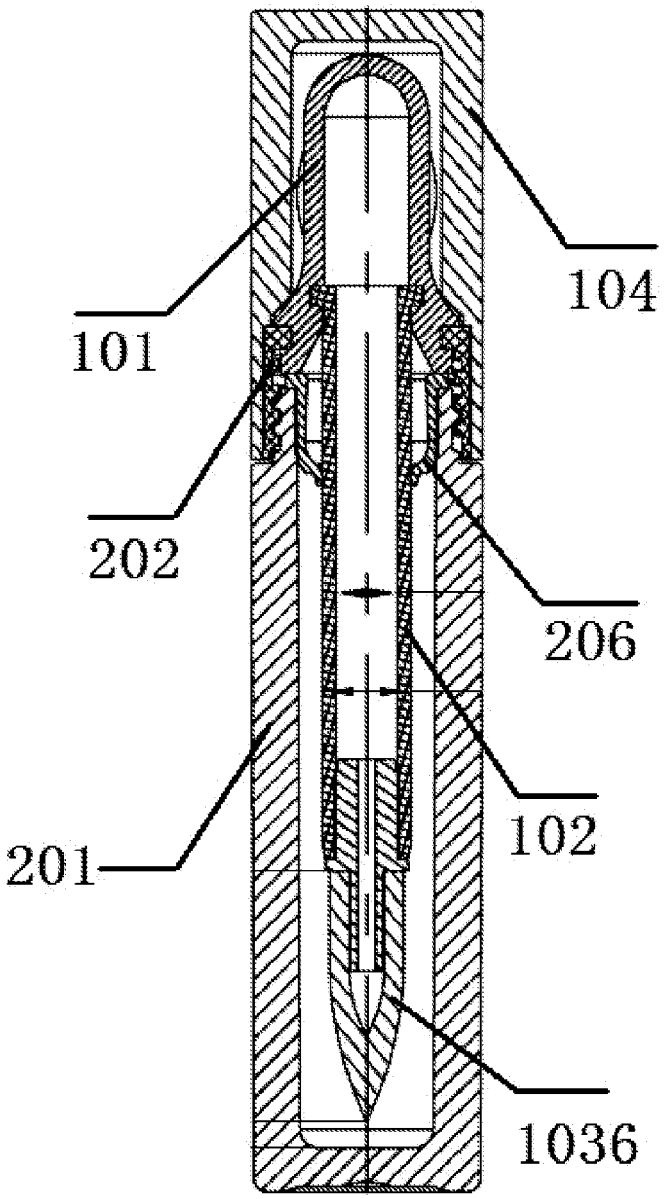
FIG. 7 is a schematic diagram of another perspective of FIG. 6.
Figure 8:
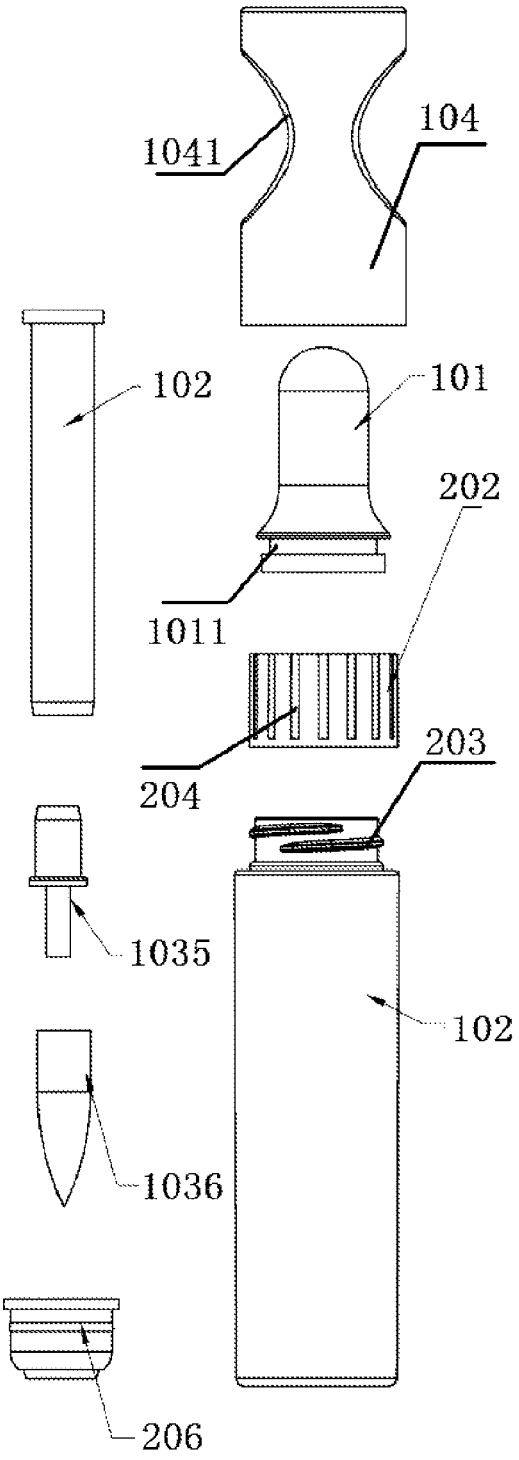
FIG. 8 is a schematic diagram of a decomposition state of FIG. 6.

FIG. 6 to FIG. 8 illustrate a cosmetics container of the other implementation manner of the present invention. The difference between the cosmetics container as illustrated in FIG. 6 to FIG. 8 and that as illustrated in FIG. 3 to FIG. 5 is that the dropper matched with the cosmetics container of this embodiment is different, the head component of the dropper matched in this embodiment is a brush, the brush comprises a brush handle 1035 and brush hairs 1036, one end of the brush handle 1035 is inserted in the tube body 102, while the other end of the brush handle 1035 is connected with the brush hairs 1036, the brush handle 1035 is a hollow structure, the interconnecting structure refers to a gap between the brush hairs 1036, the fluid may enter the tube body 102 or flow out of the tube body 102 via the gap between the brush hairs 1036 and the hollow structure of the brush handle 1035. The cosmetics may slowly flow out of the gap between the brush hairs 1036, and then the user may apply or wipe, or implement other makeup operations via the brush hairs 1036.

The above only describes some exemplary embodiments of the present invention. Those having ordinary skills in the art may also make many modifications and improvements without departing from the conception of the invention, which shall all fall within the protection scope of the invention. The embodiments of the present invention are described by taking the cosmetics container for lip glosses and eye liners for example merely, and meanwhile, the present invention may also be suitable for the containers for foundation liquids, skin care products and other cosmetics. Those all fall within the protection scope of the present invention, and meanwhile the present invention comprises droppers for cosmetics in different push types.

The invention claimed is:

1. A dropper comprising a flexible cap, a tube body and a head component, wherein the flexible cap is hermetically connected to one end of the tube body, and the head component is connected to the other end of the tube body; the tube body is a hollow tube body; the flexible cap can be deformed, and the interior thereof is a hollow structure; an internal hollow part of the tube body communicates with the internal hollow part of the flexible cap; the head component is provided with an interconnecting structure thereon for fluid to pass through, fluid thus being able to enter the tube body or flow out of the tube body via the interconnecting structure, and wherein the head component is a soft head comprising a connecting portion and a contact portion which are integrally formed, the connecting portion is inserted in the tube body, the contact portion is provided with a contact surface, the interconnecting structure refers to a through hole arranged in the contact surface, and the through hole communicates with the internal hollow part of the tube body.

2. The dropper according to claim 1, wherein the head component is a brush, the brush comprises a brush handle and brush hairs, one end of the brush handle is inserted in the tube body, while the other end of the brush handle is connected with the brush hairs, the brush handle is a hollow structure, the interconnecting structure refers to a gap between the brush hairs, the fluid may enter the tube body or flow out of the tube body via the gap between the brush hairs and the hollow structure of the brush handle.

3. The dropper according to claim 1, wherein the exterior of the flexible cap is sheathed with a top cover, the interior of the top cover is provided with an accommodating space, the flexible cap is arranged inside the top cover, a side wall of the top cover is provided with a notch, and the flexible cap corresponds to the notch.

4. The dropper according to claim 3, wherein two notches are provided and are symmetrically arranged in the side wall of the top cover, and a section view of the notch is arc-shaped.

5. The dropper according to claim 3, wherein the flexible cap is a push type flexible cap, a pressing cover is arranged above the push type flexible cap, and the pressing cover is matched with the top cover.

6. A cosmetics container comprising a container body and the dropper according to claim 1, wherein the container body has a function of accommodating fluid, and the dropper is stretched into the container body.

7. The cosmetics container according to claim 6, further comprising an inner cover, wherein the top of the container body is provided with a binding portion, the inner cover is matched with the container body via the binding portion, the top of the inner cover is hollow, the hollow part of the top of the inner cover is provided with an inward flange, and the outside of the top of the flexible cap is provided with a groove matched with the flange.

8. The cosmetics container according to claim 7, wherein the exterior of the flexible cap is sheathed with a top cover, the interior of the top is provided with an accommodating space, the flexible cap is arranged inside the top cover, a side wall of the top cover is provided with a notch, the flexible cap corresponds to the notch, two notches are provided and are symmetrically arranged in the side wall of the top cover, a section view of the notch is arc-shaped, an outside wall of the inner cover is provided with a bead, and the top cover is provided with a groove matched with the bead.

9. The cosmetics container according to claim 6, further comprising a chock plug in a hollow structure, wherein the chock plug is located at the top of the container body, the chock plug is inserted in and fixed on an opening of the container body, the tube body passes through the chock plug and is inserted inside the container body, and an inner diameter of the chock plug is matched with an outer diameter of the tube body.

* * * * *